United States Patent [19]

Kahlbacher

[11] Patent Number: 4,827,637

[45] Date of Patent: May 9, 1989

[54] APPARATUS FOR CLEARING A SURFACE OF SNOW AND DIRT

[76] Inventor: Anton Kahlbacher, St. Johanner Strasse 48, A-6370 Kitzbühel, Austria

[21] Appl. No.: 92,294

[22] Filed: Sep. 2, 1987

[30] Foreign Application Priority Data

Sep. 16, 1986 [AT] Austria ..... A2479/86
Mar. 10, 1987 [AT] Austria ..... A559/87

[51] Int. Cl.[4] ..... E01H 5/07

[52] U.S. Cl. ..... 37/237; 37/240; 37/233; 15/78; 15/256.5; 172/33

[58] Field of Search ..... 37/227, 232, 233, 237–240, 37/109, 191 A, 192 A; 172/33, 111, 124; 15/78, 79 A, 80, 82, 84, 93 R, 371, 372, 256.5, 256.52, 300 R, 340, 348

[56] References Cited

U.S. PATENT DOCUMENTS

| | | | |
|---|---|---|---|
| 509,303 | 11/1893 | Fisher | 15/80 |
| 1,617,538 | 2/1927 | Mowbray | 172/33 |
| 2,402,976 | 7/1946 | Olson | 37/109 |
| 2,408,857 | 10/1946 | James | 37/240 |
| 2,797,502 | 7/1957 | Griffith et al. | 37/240 |
| 2,847,770 | 8/1958 | Wright | 37/240 |
| 3,744,568 | 7/1973 | Beyers et al. | 172/33 |
| 4,358,905 | 11/1982 | Maxwell | 172/33 |
| 4,685,228 | 8/1987 | Gisler et al. | 37/233 |

FOREIGN PATENT DOCUMENTS

| | | | |
|---|---|---|---|
| 0164315 | 12/1985 | European Pat. Off. | 15/78 |
| 1100353 | 6/1984 | U.S.S.R. | 15/78 |
| 726689 | 3/1955 | United Kingdom | 37/191 A |

*Primary Examiner*—Eugene H. Eickholt
*Attorney, Agent, or Firm*—Herbert Dubno

[57] ABSTRACT

The apparatus for clearing a trafficked surface such as a road, express highway and airport runway of snow, slush, water, dirt and the like comprises a framework in which two rotatable drums are mounted and around which a conveyor belt for the material to be cleared movable transverse to the direction of travel or inclined in the operating location is guided. The conveyor belt is movable into a position inclined at an acute angle with respect to the normal of the trafficked surface. One of two strands of the conveyor belt is contactable on the trafficked surface while the other oppositely movable strand of the conveyor belt is liftable from the trafficked surface.

39 Claims, 13 Drawing Sheets

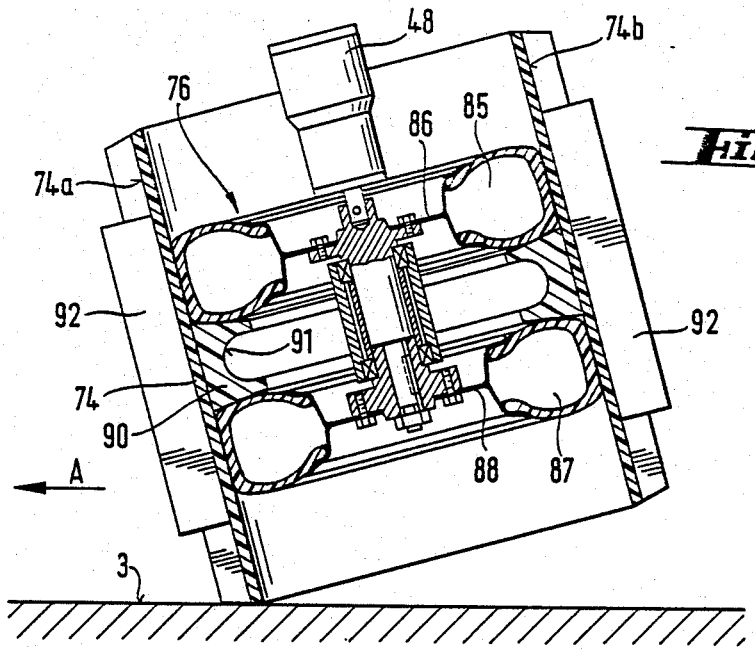
Fig. 14
Fig. 15
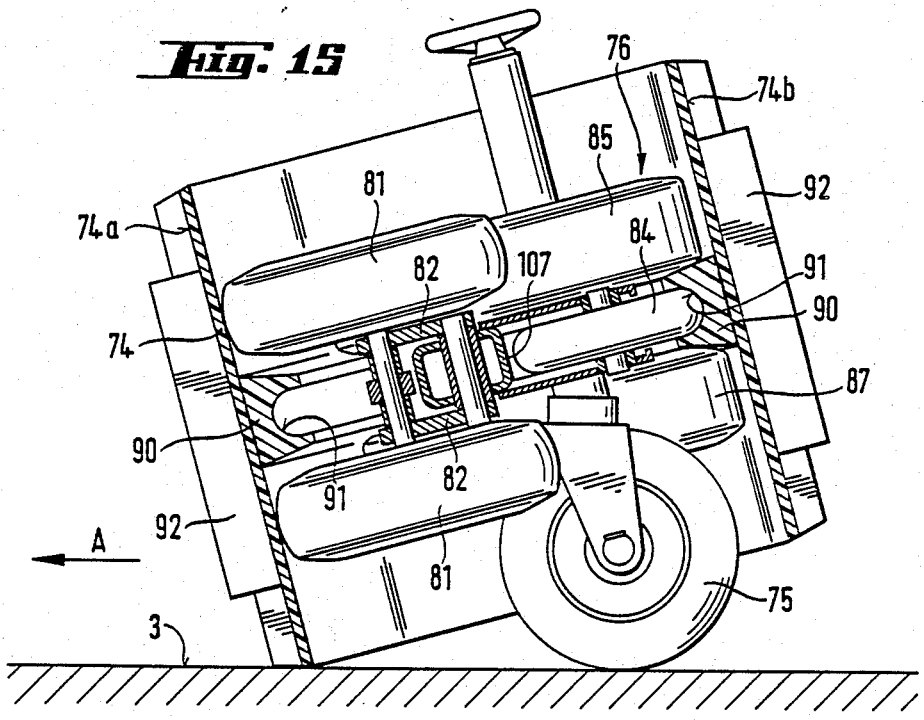

APPARATUS FOR CLEARING A SURFACE OF SNOW AND DIRT

FIELD OF THE INVENTION

My present invention relates to an apparatus for clearing, e.g. plowing, and cleaning, a traveled surface such as a road, express highway and/or airport runway of snow, slush, water, dust, dirt and the like.

BACKGROUND OF THE INVENTION

An apparatus for clearing a traveled surface such as a road, express highway and/or airport runway of snow, slush, water, dust, dirt and the like can comprise a framework in which two rotatable drums are mounted around which is guided a conveyor belt for the cleared material, movable transverse to the direction of travel or inclined in the operating location.

Airfield runways in particular require a complete cleaning of snow and/or slush since otherwise air traffic may be hindered. Besides satisfyingly high cleaning standards, the apparatus for clearing the runway must operate at very high speed since the runway is not available for takeoffs and landings during the cleaning process.

In addition the runways must not only be free of snow and/or slush but also water, dust, dirt or the like to guarantee safe flight operations. Analogous conditions exist for other traveled surfaces such as roads and express highways.

For removal of snow and/or slush found on a traveled surface, particularly a flight runway, an apparatus is known which comprises brush roller rotated in a direction opposite to the travel direction. Using this device the traveled surface can be cleared and cleaned of snow and/or slush. This apparatus is however disadvantageous since the cleared material is whirled by rotation of the brush rollers so that it is again displaced with a lateral velocity component reaching the traveled surface depending on the inclined position of the brush rollers relative to the travel direction.

This means that for cleaning a section of runway whose width depends on the length of the brush rollers and on their inclined position relative to the travel direction, the cleared material must be engaged many times by the brush rollers. Despite intervention of a rejection or deflection device, the cleared material is slung around and is fed in a spiral motion into a region lateral to the operating surface on which the apparatus works. Then a second clearing process is performed using a second clearing device or the same clearing device and the cleared material is engaged again in this second clearing process and displaced laterally a distance about equal to the operating width of the clearing apparatus. This apparatus has, therefore, very poor efficiency as far as clearing a traveled surface goes.

Another disadvantage of this apparatus is that it must be built with very long brush rollers to attain an operating width suitable for these conditions. Thus a very expensive construction is required. As a consequence this apparatus with the brush rollers is provided with a supporting arm which rests on a rotating frame at its front end on the bearing or supporting member of a carrier vehicle like a semitrailer and which is supported at its rear end by an undercarriage by which devices required for the apparatus are supported. Also brush rollers are known which have an undercarriage both at their front and rear ends so that they require a towing vehicle.

In each case, the structural requirements include very expensive longitudinally extending undercarriages in which the brush rollers are mounted and by which the loads occurring in operation are taken, e.g. by pivoting.

This is particularly necessary since in clearing of snow and/or slush, portions of the cleared material can freeze on the brush rollers. Imbalances thereby occur in the rotation which must be overcome by correspondingly heavier supports or bearings and expensive undercarriages. These measures limit the the clearing speed and thus in the operating speed.

In another clearing apparatus, a supporting frame has at least two rotatable drums around on which a conveyor belt for the cleared material is guided movable transverse to the travel direction or inclined to the operating position. In this clearing apparatus the drums are vertical so that the conveyor belt is located in a plane perpendicular or normal to the traveled surface. This known clearing apparatus also does not satisfy the objects of my invention. Therein the conveyor belt cannot be brought into contact with the traveled surface with both the front and the rear stretch simultaneously. Thus forces acting in two different directions could be transmitted by the conveyor belt to the supporting frame. Additionally the cleared material could be fed by the one stretch in a first direction and by the other stretch in the opposite direction.

As a consequence, in this known clearing apparatus the conveyor belt must be kept spaced from the traveled surface. This arrangement has the disadvantage that no complete clearing of the traveled surface can be attained. This is not particularly a disadvantage when the clearing apparatus is used for clearing small quantities of material, e.g. for small quantities of snow or to clear the traveled surface of dust; dirt. In a number of cases, particularly with airport runways, however, a very much more complete clearing of the traveled surface is desired.

OBJECTS OF THE INVENTION

It is an object of my invention to provide an improved apparatus for clearing a traveled surface such as a road, express highway and/or airport runway of snow, slush, water, dust, dirt and the like which will obviate the aforementioned drawbacks.

It is also an object of my invention to provide an improved apparatus for clearing a traveled surface such as a road, express highway and airport runway of snow, slush, water, dust, dirt and the like which provides a more complete clearing and cleaning of the traveled surface than has previously been possible in a single operation.

It is another object of my invention to provide an improved apparatus for clearing a traveled surface such as a road, express highway and airport runway of snow, slush, water, dust, dirt and the like with which a more complete, higher speed and more economical clearing process is provided.

SUMMARY OF THE INVENTION

These objects and others which will become more readily apparent hereinafter are attained in accordance with my invention in an apparatus for clearing a traveled surface such as a road, express highway and airport runway of snow, slush, water, dust, dirt and the like comprising a framework in which are mounted two rotatable drums around which a conveyor belt is guided for the cleared material movable transverse to the direction of travel or inclined in the operating location.

According to my invention the conveyor belt is movable into a position inclined at an acute angle with respect to the normal of the traveled surface. One of two belt stretches of the conveyor belt can be brought into contact with the traveled surface while the other oppositely movable belt stretch of the conveyor belt is liftable from the traveled surface. As a result a very satisfactory clearing of the traveled surface is attained without which all the above mentioned disadvantages are likely to be present.

According to a first embodiment of my invention the one of the belt stretches of the conveyor belt positioned toward the front with respect to the travel direction of the apparatus can be contacted with the traveled surface and the acute angle is between 1° and 30°. The acute angle is advantageously 8°. In another example of my invention the one of the belt stretches toward the rear with respect to the travel direction of the apparatus can be contacted with the traveled surface and the acute angle is between 1° and 30°, especially 8°.

Because of the belt stretch of the conveyor belt bearing upon the traveled surface, the material to be cleared located on it is engaged. If that were not done it would stir up and throw about the material and then transport it to the edge of the operating surface of the apparatus according to the speed the conveyor belt is driven. Then it is engaged in an additional clearing process and is displaced laterally again a distance about equal to the operating width of the clearing apparatus.

Advantageously a plurality of guide rollers for the conveyor belt can be mounted in the framework in addition to at least two rotatable drums for the conveyor belt. Further, a plurality of tension-providing rollers whose positions are adjustable relative to the framework are associated with the one of the belt stretches toward the front with respect to the travel direction of the apparatus.

The tension-providing rollers are mounted on a plurality of guide members whose pivot positions are adjustable.

The pivot position of the guide members can be made adjustable by a turnbuckle.

Also a plurality of supporting rollers can be associated with the one of the belt stretches of the conveyor belt toward the rear with respect to the travel direction of the apparatus. A sliding runner can be provided on the framework as an opposing retainer for the conveyor belt.

The conveyor belt can be kept in position and at the tension required by the conditions because of the guide rollers, tension-providing rollers, supporting rollers and sliding rails. At least one of two rotatable drums of the conveyor belt can be drivable by a hydraulic motor and the drive for the conveyor belt can be reversible.

According to another feature of my invention the conveyor belt can be made from a stiff elastic material composed of an elastic substance reinforced by an additive material. The elastic material can be rubber or a plastic material and the additive material steel fiber, steel sheet, glass fiber, carbon fiber or slag fiber.

Additional working units including cutting members and brushes can be mounted at the lower longitudinal edge of the conveyor belt. Thus a plurality of rods and/or cables can be held on the exterior of said conveyor belt. A plurality of adjustable-height brushes each under the action of at least one spring can be provided on the rods and/or the cables. A sleeve, on which a compressed spring and a brush is carried, is guided along each of the rods and/or the ropes. The clearing process effected by the conveyor belt is assisted or made easy by this cutting and/or brushing operation.

According to an additional embodiment the inner side of the conveyor belt can have a longitudinally extending profiling including a plurality of ribs and/or grooves and the outer surface of the guide rollers is also provided with a another circular sectioning including a plurality of grooves or ribs spaced from each other opposite the longitudinally extending profiling on the conveyor belt.

Thus the conveyor belt can have a plurality of ribs which are trapezoidal in cross section on the inner surface and a plurality of belt drums and guide rollers of the conveyor belt can have a plurality of trapezoidal cross section grooves. By these structures the required contact of the conveyor belt on the traveled surface is guaranteed since it is maintained at the correct height by the belt drums and the guide rollers. In so far as the elements of this profiling or sectioning are spaced equally from each other, it is possible after abrasion of the conveyor belt an amount corresponding to approximately the spacing of two elements to displace the conveyor belt downwardly with respect to the belt drum. However here the conveyor belt can be used as long as it has only a part of its original height without which its operation would be impaired.

Advantageously the guide drums are formed by a pair of rubber tires. Between them a strip enters oriented in the longitudinal direction from the inner side of the conveyor belt.

According to an additional preferred embodiment the conveyor belt is formed on its outside or on its inside with a plurality of vertically running ribs. The inside of the conveyor belt can be provide with a longitudinally running groove in which at least one guide roller projects. Also these features guarantee a good guiding of the conveyor belt.

In another feature of my invention the framework has a blower and/or a suction device. An air duct opening downward can be held by the framework. The mounting frame is couplable movably with a supporting frame of a carrier vehicle by a support pipe which acts as an air duct and the blower and/or the suction device is mounted on the supporting frame.

An air duct opening to the traveled surface which is connectable by the support pipe to the blower can be provided on the framework between the conveyor belt extending over the length of said framework. A conduit which is connected by the support pipe to the suction device can open inside the conveyor belt. Each of two branches of the support pipe can be conducted to each end of the air duct opening downwardly. A controlling cover can be located at the mouth of the support pipe and each of the branches.

Thus the controlling cover provided at the mouth of the support pipe can be a rotatable disk and the controlling covers located at the mouths of the branches can be operable opposing the action of an adjusting spring by the flow of air.

The cleaning process is assisted by a blower to improve the clearing performance of the conveyor belt and/or to allow a a ground hugging ejection of cleared material to improve performance. The cleared material can be drawn in by a suction device and fed into a collection container located on the carrier vehicle.

The framework advantageously can be provided with a plurality of wheels. At least one positioning cylinder by which the framework is liftable can be mounted on the supporting frame.

The framework can be pivotally mounted and a positioning device by which the framework is pivotable opposite the direction of travel of the apparatus can be provided between the supporting frame and the framework. The holding members for a plurality of belt drums and guide rollers can be adjustable in height and angular position with respect to the framework, whereby the height and the angular position of the conveyor belt are adjustable relative to the trafficking surface.

The supporting rail or support for the conveyor belt in the framework is pivotable about an axis running in the longitudinal direction of a carrier vehicle. The supporting rail for the conveyor belt can be held in a housing of the framework by an elastic strip or intermediate bearing member.

A sprayer can be located in front of or to the rear of the conveyor belt. A drive motor, a hydraulic pump for driving at least one belt drum of the conveyor belt, a blower and/or a suction device and a container with a feed pump can be provided on the carrier vehicle.

A snow plough can be mounted on the front end of the carrier vehicle.

To use the apparatus according to my invention so that the cleared material is either fed to the right edge or the left edge of the operating surface, the supporting device is pivotally mounted opposite the carrier vehicle and at least one positioning cylinder and one motor is provided between the carrier vehicle and the supporting device by which the transverse position of the supporting device is adjustable relative to the travel direction. Thus the drive of the conveyor belt is reversible.

To put the blower to use in a suitable way the air duct has two branch pipes at both ends of the duct opening downwardly. Control valves are located in the vicinity of the mouth of the pipe in the branch pipe and the mouth of the branch pipe in the duct by which a guiding of the blower air occurs so that it flows either from left to right or right to left into the duct open downwardly.

By definition the "working unit" includes the feed device with the conveyor belt, any brushes used to help clean the traveled surface, and any cutter elements, blowers, sprayers or the like.

By "profiling" I mean the ribs and/or grooves on the inner side of the conveyor belt and by "sectioning" I mean the grooves on the guide rollers, rotatable drums or the like.

BRIEF DESCRIPTION OF THE DRAWING

The above and other objects, features and advantages of my invention will become more readily apparent from the following description, reference being made to the accompanying highly diagrammatic drawing in which:

FIG. 14 is an enlarged cross sectional view taken along the section line XIV—XIV of FIG. 13;

FIG. 15 is an enlarged cross sectional view taken along the section line XV—XV of FIG. 13;

SPECIFIC DESCRIPTION

Figure 1:
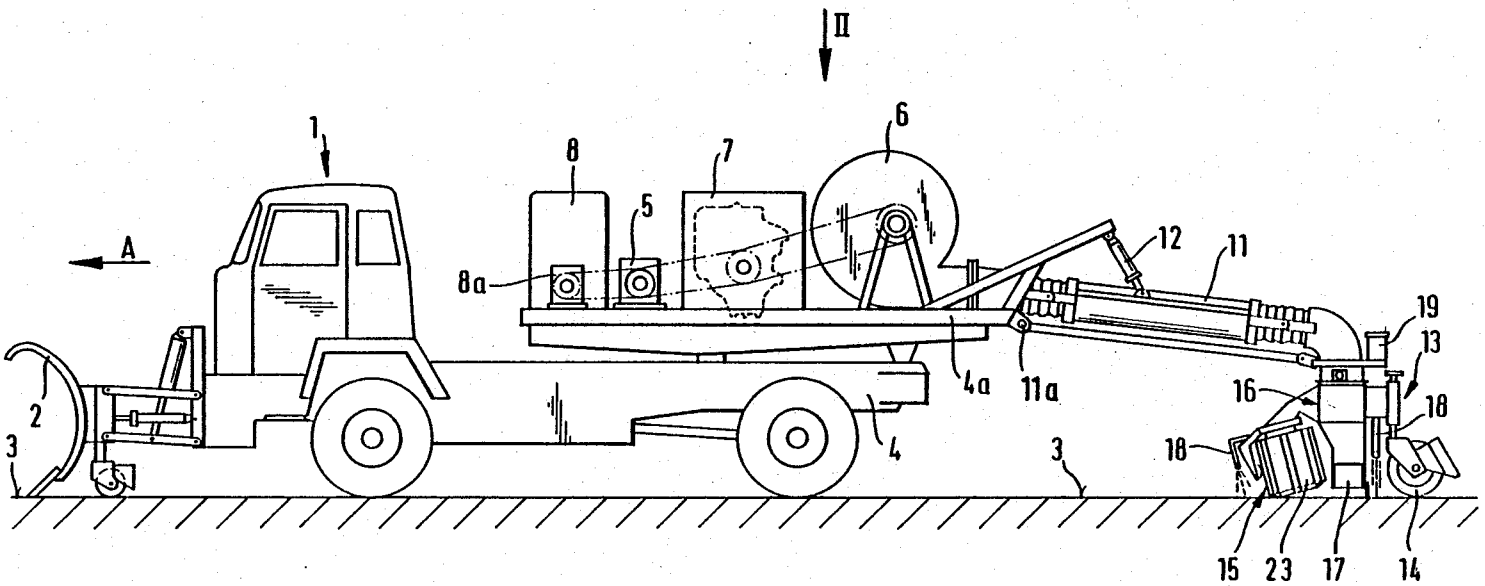
FIG. 1 is a side elevational view of a carrier vehicle with a clearing apparatus according to my invention.

A carrier vehicle 1 is shown in FIG. 1 on whose bumper or front member a known snowplow 2 is mounted in a known way. A supporting frame **4*a* is located on the load bearing member 4 of the carrier vehicle 1 by which are carried a hydraulic pump 5, a blower 6, a drive motor 7 for the blower 6 and for the hydraulic pump 5, and a container 8 for a deicer fluid with a feed pump 8*a*** are.

A support pipe 11 is attached additionally to the carrier vehicle 1 to form an air passage and which is coupled on its rear end with a clearing device which is subsequently illustrated with the aid of the remaining figures.

This clearing device includes a framework 13 which is supported by the traveled surface 3 and by which are held in place a feed device 15, an air duct housing 16 for an air duct 17 which is open at its bottom by which an air flow can be produced, and at least one sprayer 18.

The support pipe 11 is pivotable about a bolt **11*a* by a positioning cylinder 12 and can be set in its raised position by it. Additionally a positioning motor 19** is provided which acts to pivot the clearing apparatus into an inclined position with regard to the travel direction A.

Figure 2:
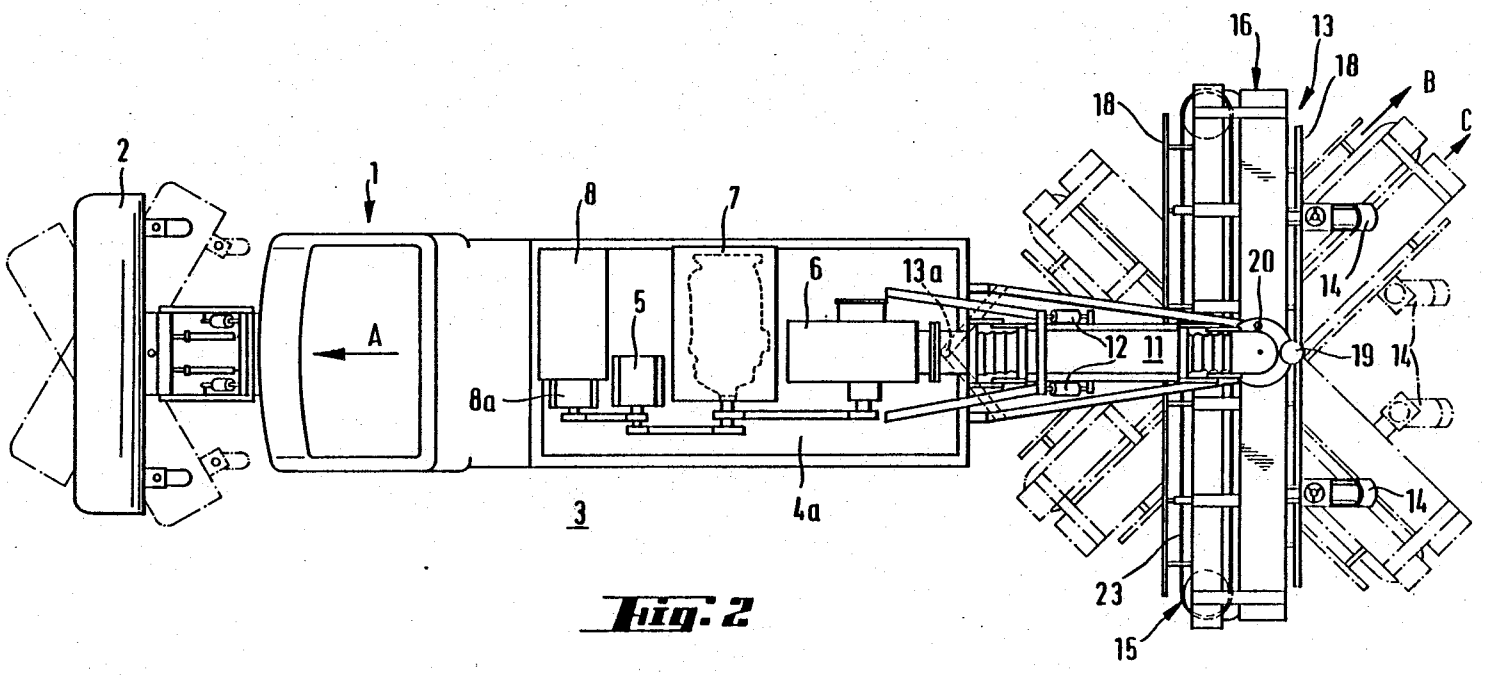
FIG. 2 is a top plan view of the carrier vehicle and clearing apparatus of FIG. 1 as seen in the direction of the arrow II.

From the top view shown in FIG. 2 of the apparatus according to FIG. 1 it is apparent that the framework 13 has a length such that it projects beyond the apparatus in an inclined position of about 45° with respect to the travel direction A.

Thus the framework 13 can be swung by a positioning motor 19 into one of two inclined positions which are shown with dot-dashed lines in FIG. 2 and which are the working positions of the clearing device.

Inasmuch as the drive for the feed device 15 occurs in the direction of the arrow B the cleared material is carried away in the direction of the arrow C on the right side in the travel direction A. The inclined position of the clearing device can be fixed by a lock bolt 20.

Since the framework is adjustable into the other inclined positions shown with dot-dashed lines and the drive of the feed device 15 is reversable, the cleared material can be carried away on the left side of the apparatus in the travel direction A. As is apparent from FIG. 2 the framework 13 can be pivotable also in a lateral direction about a support member 13*a*.

Figure 3:
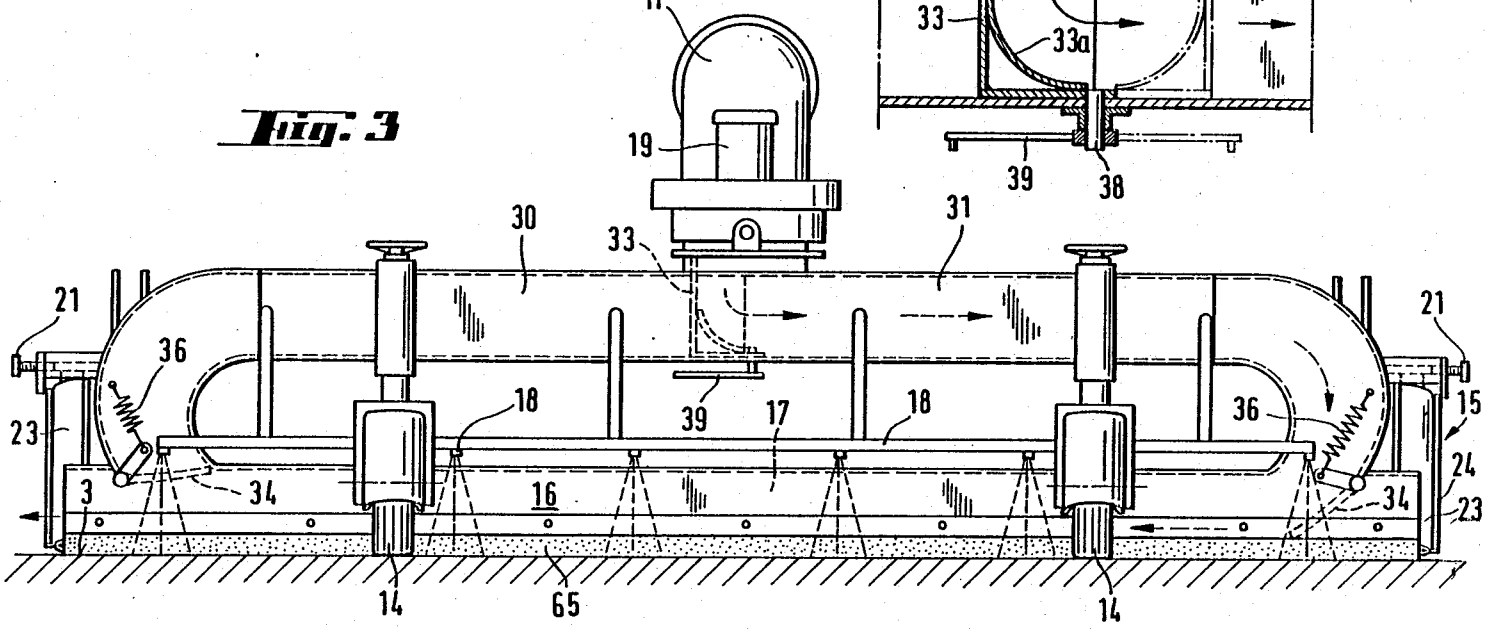
FIG. 3 is a rear view of the clearing apparatus as seen in the direction of the arrow III of FIG. 5.

As is apparent from FIG. 3 the support pipe 11 opens into two branch pipes 30 and 31 which lead to the outer ends of the air duct housing 16 for the air duct 17. A rotatable disk 33 is provided at the mouth of the support pipe 11 into the branch pipes 30, 31. Spring loaded covers 34 connected with springs 36 are provided at the entrances of the branch pipe 30, 31 in the air duct 17.

Figure 4:
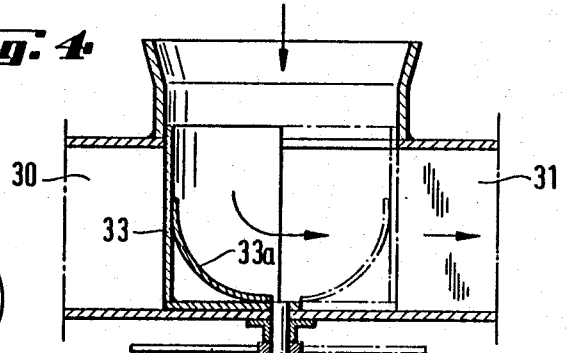
FIG. 4 is a cross sectional view taken along the section line IV—IV of FIG. 5.

From FIG. 4 it can be seen that the rotatable disk 33 is a cylinder in this embodiment in which a curved air flow deflection plate 33*a* is mounted. This rotatable disk 33 is coupled by a pin 38 locked with a lever 39. By rotation of the lever 39 a rotation of the rotatable disk 33 occurs. The air flow fed from the blower 6 is guided from one of the branch pipes 30, 31 into the other by rotation of the rotatable disk 33.

Figure 5:
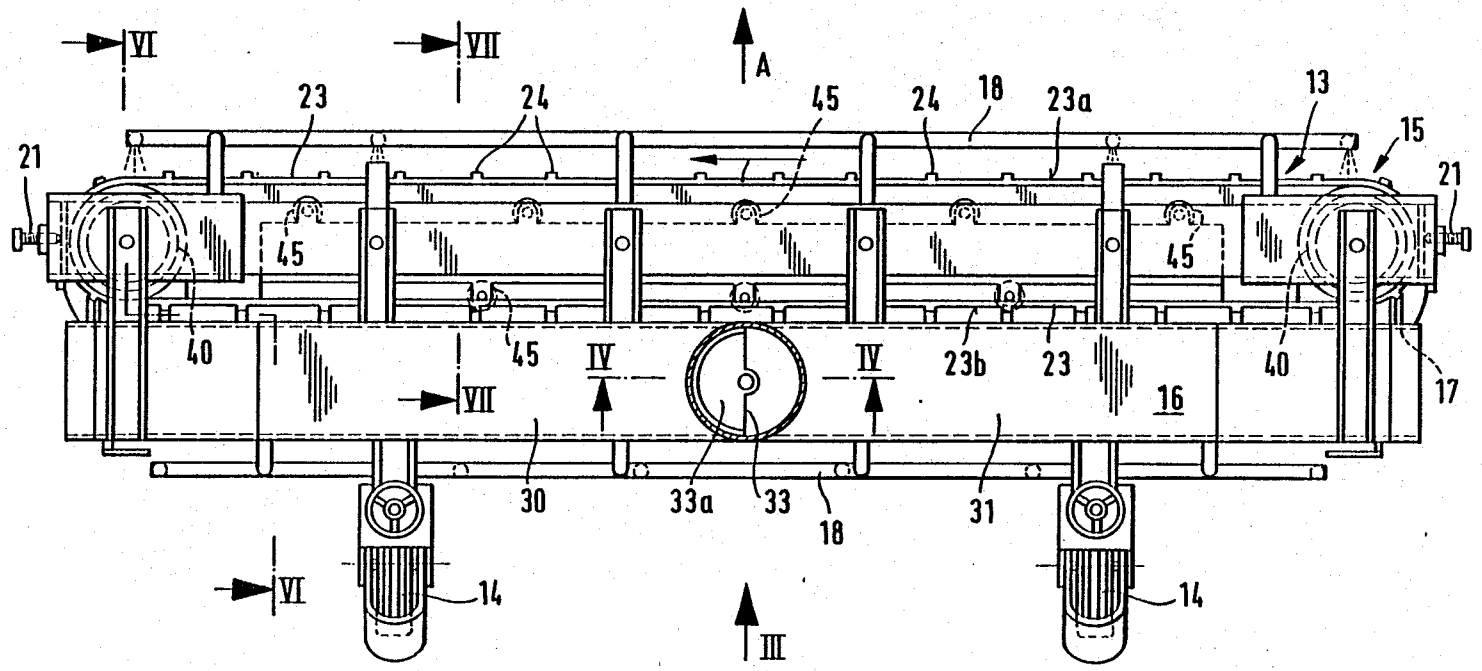
FIG. 5 is a top view of the clearing apparatus.

As can be seen from FIG. 5 the supporting framework 13 is provided at each of its ends with a belt or rotatable drum 40 around which a conveyor belt 23 is guided. Further a plurality of guide rollers 45 for the conveyor belt 23 are mounted along the length of the framework 13 in it.

The conveyor belt 23 has a plurality of nearly vertically running ribs 24 on its outer side. The air duct housing 16 which forms the air duct 17 open to the traveled surface 3 is supported by the mounting framework 13. The support pipe 11 is connected to the air duct housing 16. The belt drums 40 are held in horizontal guides and are slidable by positioning spindles 21 whereby the tension on the conveyor belt 23 is adjustable.

Figure 6:
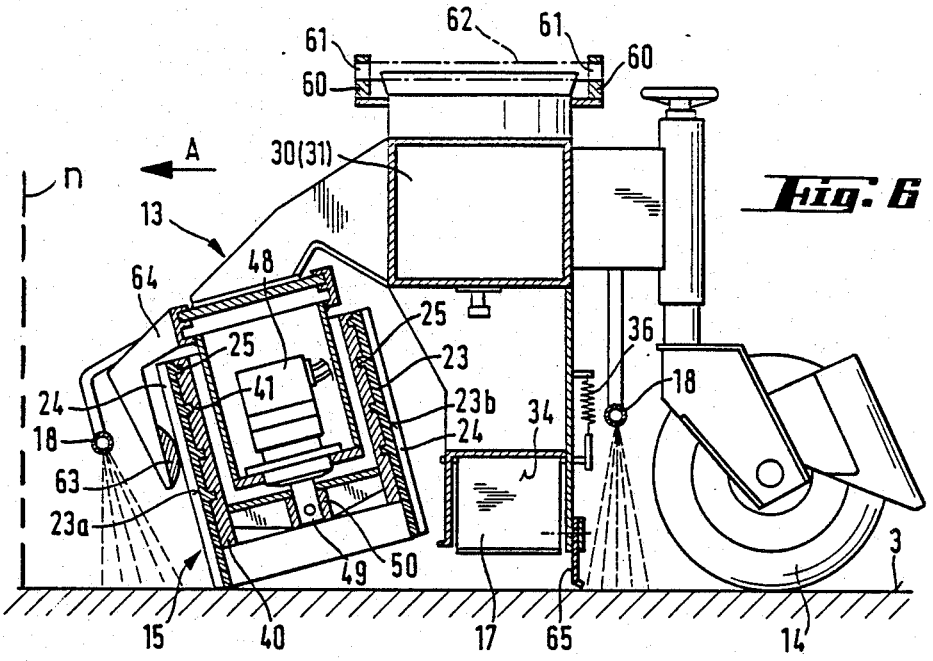
FIG. 6 is an enlarged cross sectional view taken along the section line VI—VI of FIG. 5.
Figure 7:
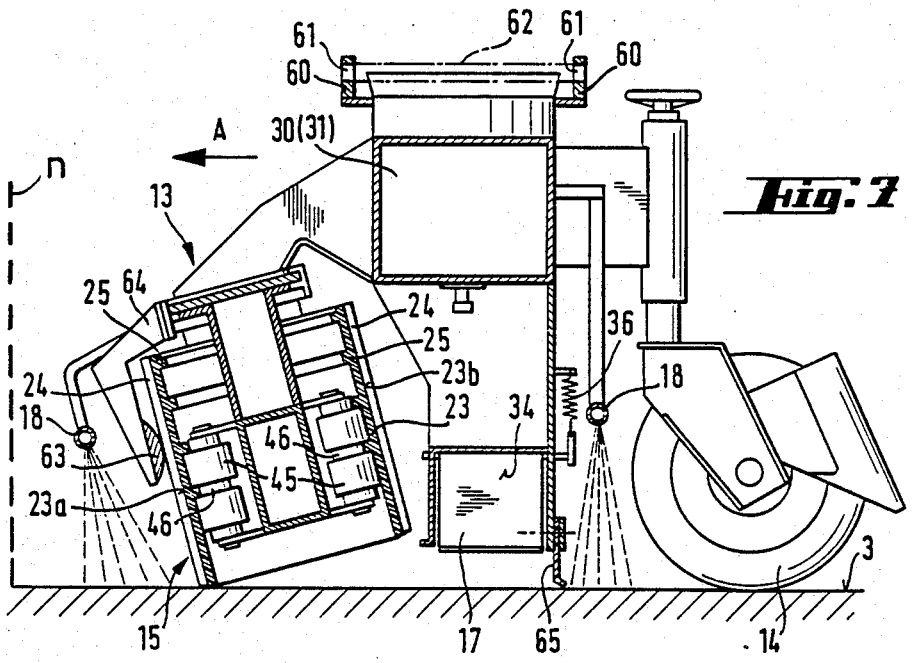
FIG. 7 is a cross sectional view through the apparatus of FIG. 5 drawn to a larger scale.

As FIGS. 6 and 7 show the conveyor belt 23 has a plurality of inwardly projecting ribs 25 on its inner side which are nearly horizontal, i.e. run in the same longitudinal direction. In an analogous way the belt drums 40 and the guide rollers 45 are formed with circumferential grooves 41, 46 spaced from each other over their height in which the inner ribs 25 of the conveyor belt 23 project. The conveyor belt 23 is made from stiff elastic material such as rubber or plastic.

To increase the required abrasivity the conveyor belt 23 can be reinforced by insertion of an additive material comprising steel fibers, steel plates, glass fibers, carbon fibers, slag fibers or the like. Because it is subject to frictional wear based on the fact that the ribs 25 of the conveyor belt located on the inner side and/or the grooves 41, 46 of the belt drums 40 and/or the guide rollers 45 are located spaced equally from each other, there is a possibility after abrasion by the conveyor belt 23 of its displacement a certain amount downwardly corresponding to the spacing of the ribs 25.

The frame for the framework 13 is formed on its upper end with two flanges 60 which are provided with mounting eyes 61 by which the framework 13 is held in its center portion by a bolt 62 so that it can be fit to the slope of the traveled surface 3.

On the upper portion of the front belt stretch 23*a* of the conveyor belt 23 a sliding runner 63 is located which is supported by an arm 64. This sliding runner 63 acts to prevent raising of the front belt stretch 23*a* of the conveyor belt 23 from the guide rollers 45.

A hydraulic motor 48 is located inside at least one of the belt drums 40 which drives the conveyor belt 23. The shaft 49 of this motor 48 is coupled and locked with a hub 50 of the belt drum 40. The air duct 17 is open to the conveyor belt 23 whereas an elastic strip 65 adjustable in height closes off the rear of the apparatus and is attached at the rear of this air duct.

In the operating position of the conveyor belt 23 which is apparent from FIGS. 6 and 7, the belt is held so that the front belt stretch 23*a* is inclined at an angle of about 8° to the normal n of the traveled surface 3 and contacts the traveled surface 3. When the conveyor belt 23 is in the inclined position, the rear belt stretch 23*b* section of the belt is located in a space away from the traveled surface. By driving the conveyor belt 23, materials located near the front belt stretch 23*a* of the conveyor belt 23 and that are on the traveled surface such as snow and/or slush, water, dust, or dirt are grasped or engaged and are carried away laterally in the direction of motion of the conveyor belt 23.

The feed of the material to be cleared is aided by air fed downwardly in the air duct 17 through the support pipe 11 and one of the branch pipes 30, 31 which flows away transversely.

According to the position of the rotating disk 33, therefore, the air flow is fed either to the left end or the right end of the air duct 17 and flows through it to the other end in the direction of the conveyor belt feed. Thereby the cleared material is blown away laterally at a low level above the traveled surface 3. The angle at which the fron belt stretch 23*a* can be oriented with respect to the normal n of the traveled surface 3 can be between 1° and 30°.

Figure 8:
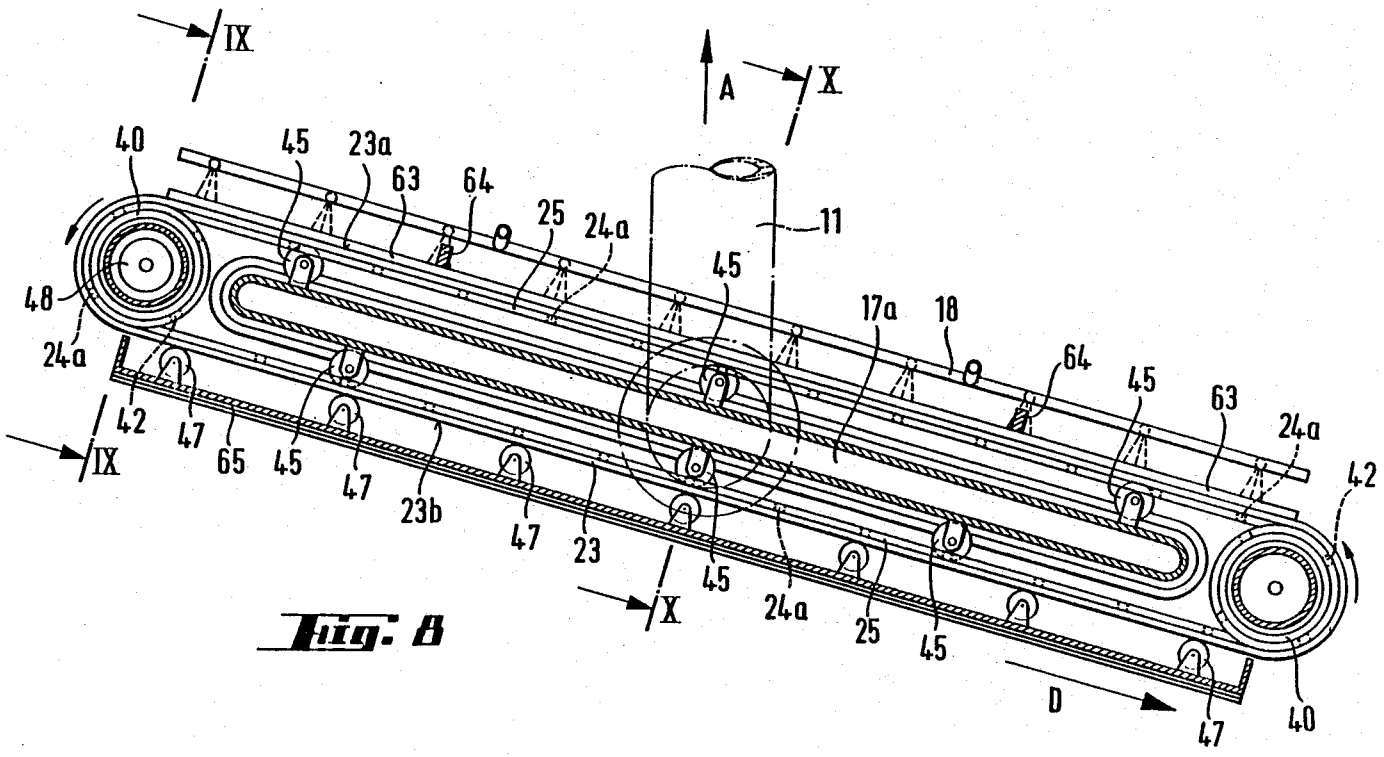
FIG. 8 is a cross sectional view of a second embodiment of the clearing apparatus according to my invention taken along the section line VIII—VIII of FIG. 9.
Figure 9:
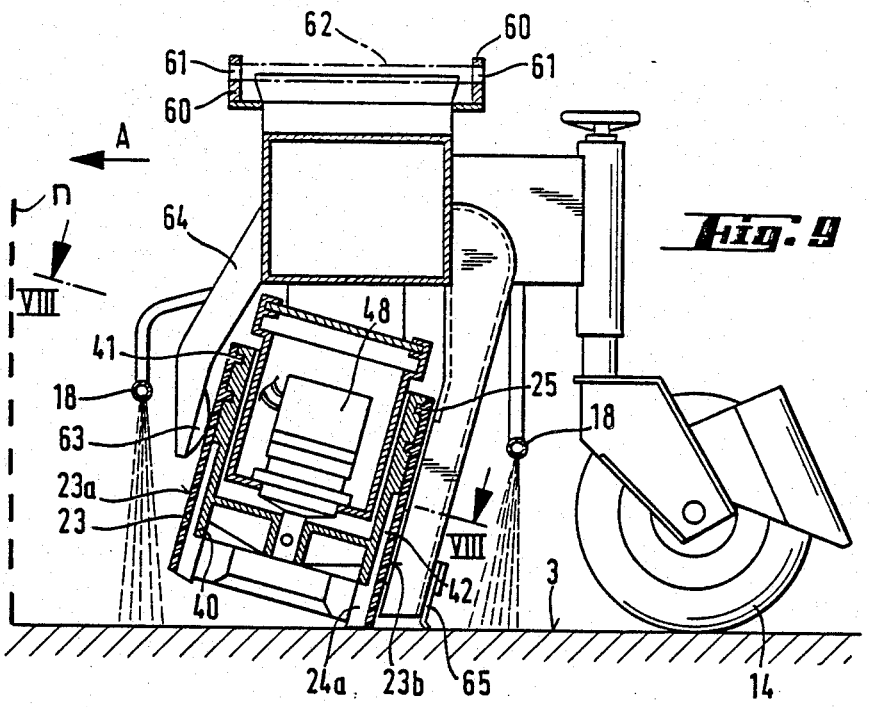
FIG. 9 is an enlarged cross sectional view taken along the section line IX—IX of FIG. 8.
Figure 10:
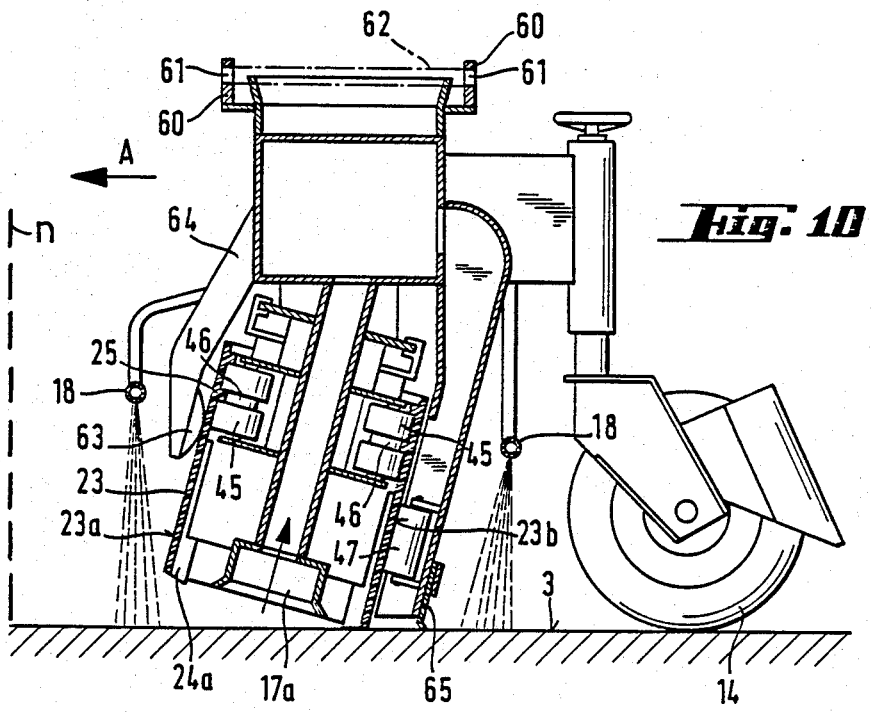
FIG. 10 is an enlarged cross sectional view taken along the section line X—X of FIG. 8.

A variant of the clearing apparatus reported above is illustrated in cross sectional and plan views in FIGS. 8 to 10. The front belt stretch 23*a* of the conveyor belt 23 is lifted from the traveled surface 3 and the rear belt stretch 23*b* contacts it. It makes an angle of about 8° to the normal n of the traveled surface 3. This angle can be between 1° and 30°. Also the inner side of the conveyor belt 23 not only is provided with a plurality of horizontal strips 25 but also a plurality of vertical strips 24*a* which are associated with vertical grooves 42 and horizontal grooves 41, 46 positioned to correspond to the guide rollers 45. In this embodiment of the clearing device the suction duct 11 inside of the loop formed by the conveyor belt 23 opens into a conduit 17*a*. Also rear supporting rollers 47 are provided.

In operation of this clearing apparatus the conveyed material is fed inside the conveyor belt 23 whose lower belt stretch 23*b* which contacts on the traveled surface moves in the direction of the arrow D. This material is fed through the support or support pipe 11 acting as a suction duct into a collector container found on carrier vehicle 1.

A third embodiment of my apparatus is illustrated next which is simpler than the previous embodiment in that it is formed without a blower or suction device. This apparatus is positioned on the front end of the carrier vehicle 1 instead of a snowplow.

Figure 11:
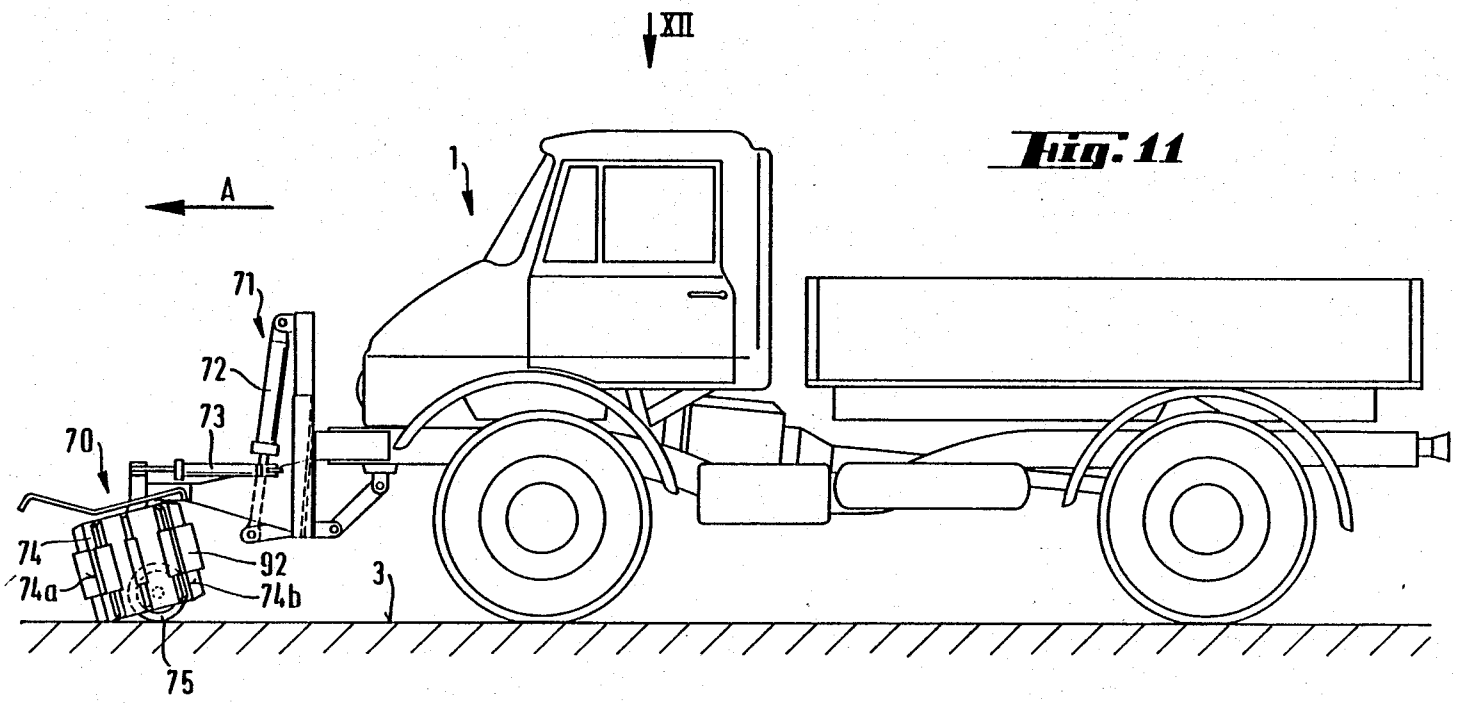
FIG. 11 is a side elevational view of a third embodiment of the clearing apparatus according to my invention as seen in the direction of the arrow XI of FIG. 12.
Figure 12:
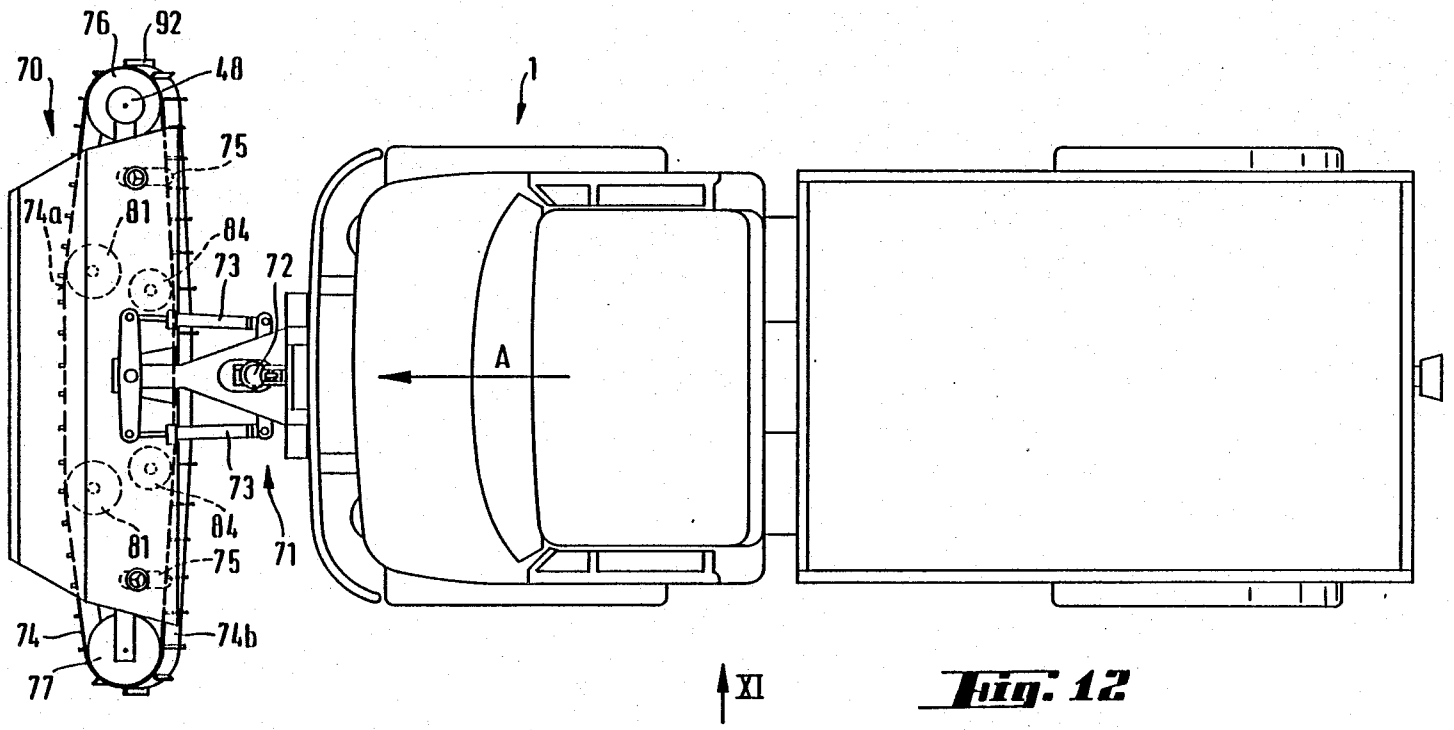
FIG. 12 is a top plan view of the third embodiment as seen in the direction of the arrow XII of FIG. 11.

As is apparent from FIGS. 11 and 12 this clearing apparatus 70 is mounted by a coupling device 71 on the front end of the carrier vehicle 1. It is similarly formed with a conveyor belt 74 and supported by a wheel 75. The conveyor belt 74 is mounted around two belt drums 76 and 77 and is driven by a motor. The height of the conveyor belt 74 is adjusted by a nearly vertically aligned cylinder 72. The inclined position of this apparatus to the travel direction is adjusted by two lateral cylinders 73.

Figure 13:
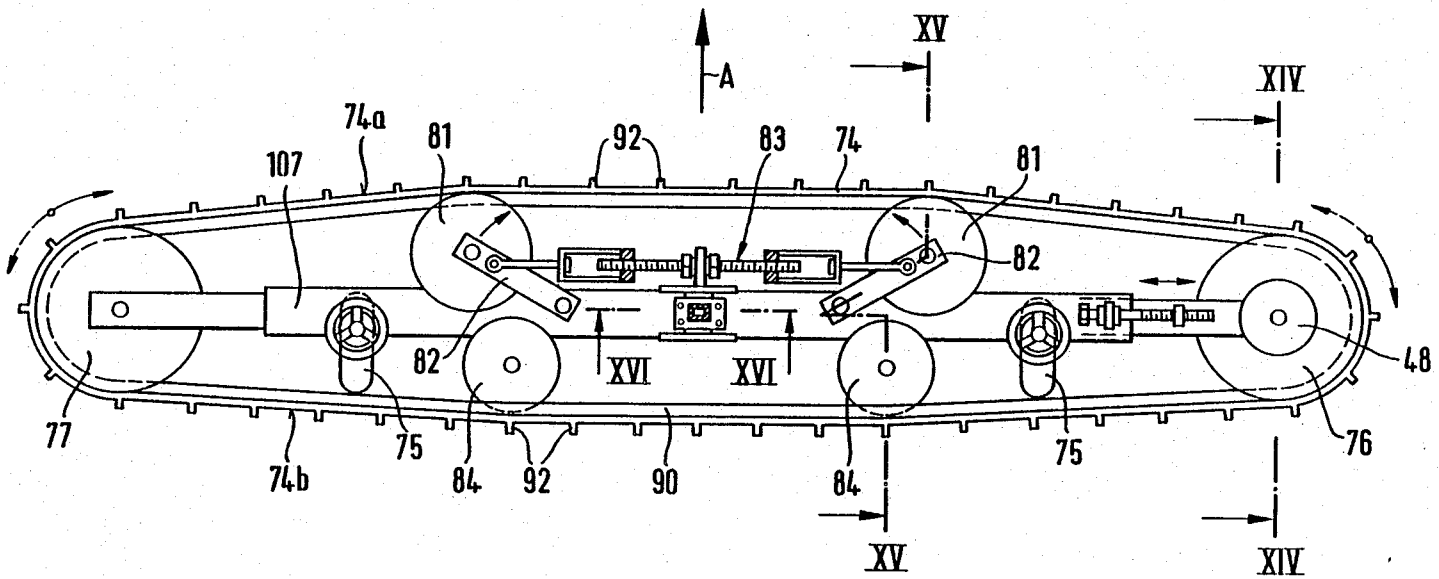
FIG. 13 is a top plan view of the third embodiment of the clearing apparatus of FIG. 11.

In FIG. 13 this apparatus is schematically illustrated. As is apparent the conveyor belt 74 is put around the drive drum 76 and the guide drum 77. Also two pairs of tension-providing rollers 81 are located at front belt stretch 74*a* and two guide rollers 84 are located at the rear belt stretch 74*b*. The tension-providing rollers 81 are mounted on guide members 82 which are pivotable by a turnbuckle 83. As a result the front belt stretch 74*a* of the conveyor belt 74 can be provided with tension by adjustment of the pivot position of the tension-providing rollers 81 and/or can be changed in its location with respect to the framework for the apparatus.

As is apparent from FIG. 14 the drive drum 76 is formed by two foamed tires 85 and 87 whose hubs 86 and 88 are rigidly connected with each other. The guide drum 77 is formed in the same way. The conveyor belt 74 has a plurality of ribs 90 on its inner side located centrally in regard to the height of the conveyor belt 74 which project between both tires 85 and 87. Thus the conveyor belt 74 is maintained at the required height despite the loads acting on it. On its outer side the conveyor belt 74 has a plurality of ribs 92 oriented transversely to its longitudinal direction.

As is apparent from FIG. 15 the conveyor belt 74 is supported in the central region in regard to its height by guide rollers 84 which project into grooves 91 in the ribs 90. By the tension-providing rollers 81 which are located on the upper portion and the lower portion of the conveyor belt 74, the latter is movable in the center between the drive and guide drums 76 and 77 slightly forward in the travel direction A. Because of the inclined position of the conveyor belt 74 the front belt stretch 74*a* located in the center contacts with greater pressur on the traveled surface 3 and/or the tendency that the front belt stretch 74*a* is lifted away in the central region between the drive and guide drums 76, 77 is opposed. As a result a satisfactory clearing effect is attained.

As has been described above the conveyor belt 74 is maintained in an inclined position in regard to the traveled surface 3. As a result, its front belt stretch 74*a* comes into contact with the ground during operation of the traveled surface 3 while the rear belt stretch 74*b* is lifted from the ground. Material found contacting the front belt stretch 74*b* of the conveyor belt 74 which contacts on the traveled surface during motion of the conveyor belt 74 is carried away.

Figure 16:
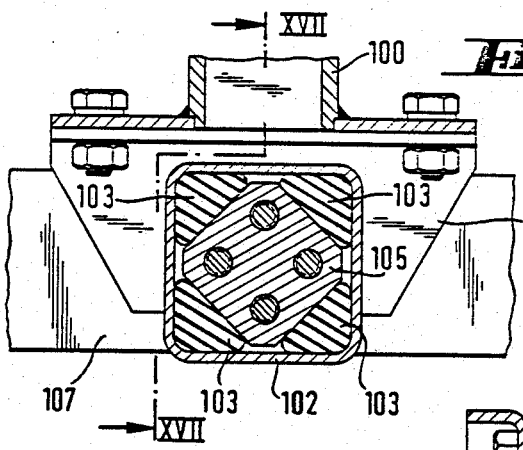
FIG. 16 is an enlarged cross sectional view taken along the section line XV—XV of FIG. 13.
Figure 17:
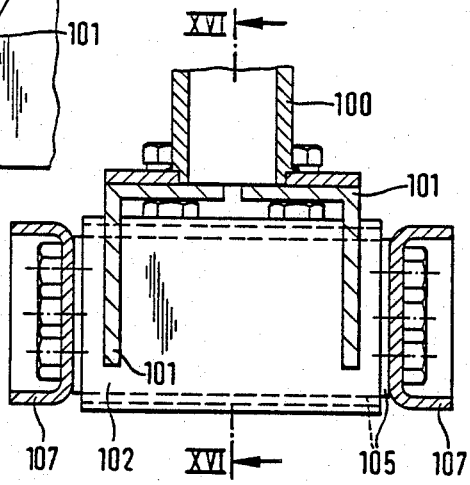
FIG. 17 is a cross sectional view taken along the section line XVII—XVII of FIG. 16.

The mounting of the clearing apparatus is shown in FIGS. 16 and 17. As is apparent the supporting frame 4*a* is rigidly attached with the carrier vehicle 1 by a supporter pipe 100. A retaining plate 101 which is formed with a housing 102 is attached to the supporter pipe 100 in which four elastic strips 103 rre positioned. A bolt 105 is held by these elastic strips 103 on which rails 107 are attached on both sides. The rails 107 form the supporting frame of the clearing apparatus. By this flexible attachment of the supporting frame, the clearing apparatus can perform a pivotal motion relative to its retaining members whereby it can be adjusted to the inclination fitting the surface to be cleared.

Figure 18:
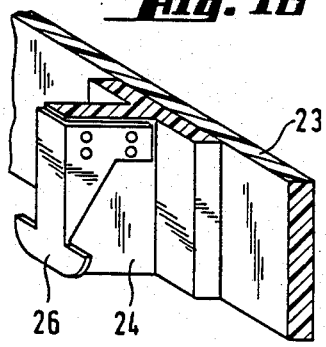
FIGS. 18 to 21 are cross sections of additional embodiments of the conveyor belt used in the apparatus.
Figure 19:
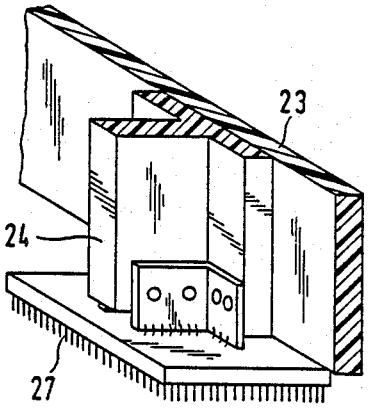
Figure 20:
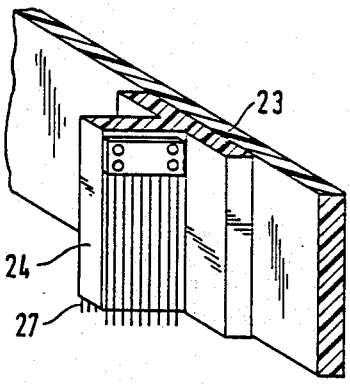

In FIG. 18 it is shown that the strips 24 of the conveyor belt 23 can be formed with metallic cutting members 26 by which the cleared material can be chopped up and/or perforated. From FIGS. 19 and 20 it is apparent that the strips 24 of the conveyor belt 23 have a brush or brushes 27 so that the traveled surface 3 can be further cleaned.

Figure 21:
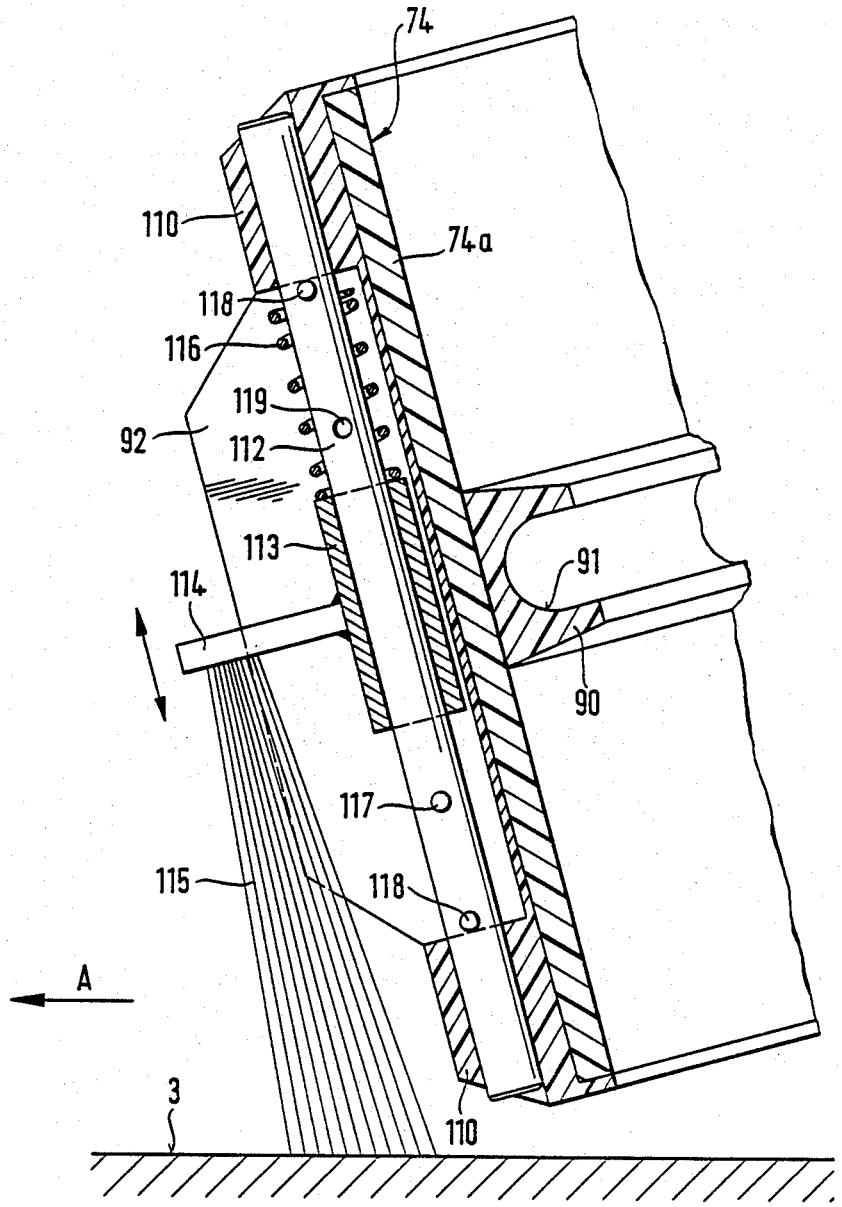

In FIG. 21 an additional feature of the conveyor belt 74 is shown. It has a plurality of upper and lower longitudinal strips 110 on its outside on which rods and/or cables 112 are attached. Sleeves 113 with bolts 114 projecting transversely therefrom are mounted on the rods and/or cables 112. Downwardly directed brushes 115 are supported by the bolts 114. The sleeves 113 stand under the action of a compressible spring 116. Their displacement is limited by a stop, e.g. a bolt. The passages 119 are provided which act as receptacles for contact pins.

Since the brushes 115 are pressed by spring 116 on the traveled surface it similarly performs a clearing operation. When the displacement of the sleeve 113 is bounded by the stop 117, the brush 115 located on the front belt stretch 74*a* of the conveyor belt 74 becomes active. To simply maintain a continuous operation as soon as the lower edge of the conveyor belt 74 is worn by abrasion so that it is no longer functional, the belt can be turned upside down because of the highly symmetrical nature of its structure.

I claim:

1. In an apparatus for clearing a traveled surface such as a road, express highway and airport runway of such material as snow, slush, water, dust, dirt and other debris comprising a framework supporting two rotatable drums, a conveyor belt surrounding said drums for removing the material to be cleared, and a means for moving said belt transverse to the direction of travel, the improvement wherein said means is capable of moving the conveyor belt into a position inclined at an acute angle with respect to the normal of said traveled surface, one of two belt stretches of said conveyor belt being contactable on said traveled surface while the other oppositely movably belt stretch of said conveyor belt being liftable from said traveled surface.

2. The improvement defined in claim 1 wherein the one of said belt stretches toward the front with respect to the travel direction of said apparatus is contactable to said traveled surface and said acute angle is between 1° and 30°.

3. The improvement defined in claim 2 wherein said acute angle is 8°.

4. The improvement defined in claim 1 wherein the one of said stands toward the rear with respect to the travel direction of said apparatus is contactable to said traveled surface and said acute angle is between 1° and 30°.

5. The improvement defined in claim 4 wherein said acute angle is 8°.

6. The improvement defined in claim 1 wherein a plurality of guide rollers for said conveyor belt are mounted in said framework in addition to at least two of said rotatable drums for said conveyor belt.

7. The improvement defined in claim 1 wherein a plurality of tension-providing rollers whose positions are adjustable relative to said framework are associated with the one of said belt stretches toward the front with respect to the travel direciton of said apparatus.

8. The improvement defined in claim 7 wherein said tension-providing rollers are mounted on a plurality of guide members whose pivoted position is adjustable.

9. The improvement defined in claim 8 wherein said pivoted position is adjustable by a turnbuckle.

10. The improvement defined in claim 1 wherein a plurality of supporting rollers are associated with the one of said belt stretches of said conveyor belt toward the rear with respect to the travel direction of said apparatus.

11. The improvement defined in claim 1 wherein a sliding runner is provided on said framework as an opposing retainer for said conveyor belt.

12. The improvement defined in claim 1 wherein there is included a hydraulic motor and at least one of said two rotatable drums of said conveyor belt is drivable by said hydraulic motor.

13. The improvement defined in claim 12 wherein said hydraulic motor is reversible.

14. The improvement defined in claim 1 wherein said conveyor belt is made from a stiff elastic material including an elastic substance reinforced by an additive material.

15. The improvement defined in claim 14 wherein said elastic material comprises rubber or a plastic material and said additive material comprises steel fiber, steel sheet, glass fiber, carbon fiber or slag fiber.

16. The improvement defined in claim 1 wherein additional working units including at least one cutting member and/or at least one brush are mounted at the lower longitudinal edge of said conveyor belt.

17. The improvement defined in claim 1 wherein a plurality of rods and/or cables are held on the exterior of said conveyor belt, a plurality of adjustable-height brushes each under the action of at least one spring being provided on said rods and/or said cables.

18. The improvement defined in claim 17 wherein a sleeve on which a compressible one of said springs and one of said brushes is carried is guided along each of said rods and/or said ropes.

19. The improvement defined in claim 1 wherein a guide drum and drive drum of said rotatable drums of said conveyor belt are each formed by a pair of rubber tires, a strip oriented in the longitudinal directio from the inner side of said conveyor belt projecting between said tires.

20. The improvement defined in claim 1 wherein the outside and the inside of said conveyor belt is provided with a plurality of vertically running ribs.

21. The improvement defined in claim 1 wherein the inside of said conveyor belt is provide with a longitudinally running groove in which at least one guide roller projects.

22. The improvement defined in claim 1 wherein said framework supports a means for moving by air manipulation the material to be cleared, said means selected from the group consisting of a blower and a suction device.

23. The improvement defined in claim 22 wherein an air conduit opening downwardly is held by said framework.

24. The improvement defined in claim 22 wherein said framework is coupable movably with a supporting frame of a carrier vehicle by a support pipe which acts as an air duct and said means for moving by air manipulation the material to be cleared is mounted on said supporting frame.

25. The improvement defined in claim 22 wherein a conduit which is connected by a support pipe to said suction device opens inside said conveyor belt.

26. The improvement defined in claim 1 wherein said framework is provided with a plurality of wheels.

27. The improvement defined in claim 1 wherein at least one positioning cylinder by which said framework is liftable is mounted on said framework.

28. The improvement defined in claim 1 wherein there is supporting frame and said framework is pivotally mounted and a positioning device by which said framework is pivotable opposite the direction of travel of said apparatus is provided between said supporting frame and said framework.

29. The improvement defined in claim 1 wherein a supporting rail for said conveyor belt is pivotable in said framework about an axis running in the longitudinal direction of a carrier vehicle.

30. The improvement defined in claim 29 wherein said supporting rail for said conveyor belt is held in a housing of said framework by an elastic grip or intermediate bearing member.

31. The improvement defined in claim 1 wherein a sprayer is located in front of said conveyor belt.

32. The improvement defined in claim 1 wherein there are provided on a carrier vehicle for said apparatus, a hydraulic pump for driving at least one of said rotatable drums of said conveyor belt, a means for moving by air manipulation the material to be cleared selected from the group consisting of a blower, a suction device and mixtures thereof, and a drive motor for drivng said means for moving by air manipulation the material to be cleared.

33. The improvement defined in claim 1 wherein a snowplow is mounted on the front end of a carrier vehicle for said apparatus.

34. The improvement defined in claim 1 wherein a sprayer is located to the rear of said conveyor belt.

35. In an apparatus for clearing a traveled surface such as a road, express highway and airport runway of such material as snow, slush, water, dust, dirt and other debris comprising a framework supporting two rotatable drums, a conveyor belt surrounding said drums for removing the material to be cleared, and a means for moving said belt transverse to the direction of travel, the improvement wherein said means is capable of moving the conveyor belt into a position inclined at an acute angle with respect to the normal of said traveled surface, one of two belt stretches of said conveyor belt being contactable on said traveled surface while the other oppositely movable belt stretch of said conveyor belt being liftable from said traveled surface, a plurality of guide rollers for said conveyor belt are mounted in said framework in addition to at least two of said rotatable drums for said conveyor belt and the inner side of said conveyor belt has a longitudinally extending profiling including a plurality of means for maintaining positioning of said belt on said guide rollers which means are selected from the group consisting of ribs, grooves and mixtures thereof and the outer surface of said guide rollers is also provided with a circular sectioning including a plurality of complementary means, which complementary means is selected from the group consisting of ribs, grooves and mixtures thereof spaced from each other opposite said longitudinally extending profiling on said conveyor belt.

36. The improvement defined in claim 35 wherein said conveyor belt has a plurality of said ribs each having a trapezoidal cross section on said inner surface and a plurality of said rotatable drums and said guide rollers of said conveyor belt have a plurality of trapezoidal cross section grooves.

37. In an apparatus for clearing a traveled surface such as a road, express highway and airport runway of such material as snow, slush, water, dust, dirt and other debris comprising a framework supporting two rotatable drums, a conveyor belt surrounding said drums for removing the material to be cleared, and a means for moving said belt transverse to the direction of travel, the improvement wherein said means is capable of moving the conveyor belt into a position inclined at an acute angle with respect to the normal of said traveled surface, one of two belt stretches of said conveyor belt being contactable on said traveled surface while the other oppositely movable belet stretch of said conveyor belt being liftable from said traveled surface, said framework supporting a blower for moving by air manipulation the material to be cleared, an air duct open to said traveled surface which is connectable by a support pipe to said blower is provided on said framework between said conveyor belt extending over the length of said framework.

38. In an apparatus for clearing a traveled surface such as a road, express highway and airport runway of such material as snow, slush, water, dust, dirt and other debris comprising a framework supporting two rotatable drums, a conveyor belt surrounding said drums for removing the material to be cleared, and a means for moving said belt transverse to the direction of travel, the improvement wherein said means is capable of moving the conveyor belt into a position inclined at an acute angle with respect to the normal of said traveled surface, one of two belt stretches of said conveyor belt being contactable on said traveled surface while the other oppositely movable belet stretch of said conveyor belt being liftable from said traveled surface, said framework supports a means for moving by air manipulation the material to be cleared, said means selected from the group consisting of a blower and suction device, an air conduit opening downwardly is held by said framework, and a support pipe including two branches, each of the two branches of said support pipe being conducted to each end of said air conduit opening downwardly, a controlling cover being located at the mouth of said support pipe and each of said branches.

39. The improvement defined in claim 37 wherein there is an adjusting spring and said controlling cover provided at the mouth of said support pipe is a rotatable disk and said controlling covers located at the mouths of said branches are operable by the flow of air in opposition to action of said adjusting spring.

* * * * *